US005781973A

United States Patent [19]

Orzel

[11] Patent Number: 5,781,973

[45] Date of Patent: Jul. 21, 1998

[54] SPREADER FOR CALENDAR LINE

[75] Inventor: Edward S. Orzel, Parma, Ohio

[73] Assignee: The North American Manufacturing Company, Cleveland, Ohio

[21] Appl. No.: 938,567

[22] Filed: Sep. 26, 1997

[51] Int. Cl.[6] ..... D06C 3/06

[52] U.S. Cl. ..... 26/75; 26/97; 26/105

[58] Field of Search ..... 26/74, 75, 88, 26/97, 99, 103, 105, 77; 226/17, 23, 190; 28/212, 282, 248, 268

[56] References Cited

U.S. PATENT DOCUMENTS

| | | | |
|---|---|---|---|
| 1,376,736 | 5/1921 | Thornber | 26/97 |
| 1,563,704 | 12/1925 | Greis | 26/105 |
| 2,639,483 | 5/1953 | Wester | 26/75 |
| 2,806,694 | 9/1957 | Penman | 26/75 |
| 3,462,053 | 8/1969 | Behr | 26/97 |
| 4,007,865 | 2/1977 | Crandall | 26/97 |
| 4,301,579 | 11/1981 | Van Den Hoven | 26/105 |
| 4,554,714 | 11/1985 | Cho | 26/75 |
| 4,920,622 | 5/1990 | Mair et al. | 26/75 |
| 5,619,779 | 4/1997 | Geyer | 26/97 |

OTHER PUBLICATIONS

Bulletin No. 10191—Apr. 1991 By North American Manufacturing Company Four (4) Pages "Calendar Lines 'Total Concept'".

*Primary Examiner*—Amy B. Vanatta
*Attorney, Agent, or Firm*—Vickers, Daniels & Young

[57] ABSTRACT

A spreader for spreading a fabric having upper and lower sides, transversely spaced edges and longitudinally extending tire reenforcing cords spaced laterally across the fabric between the edges preparatory to rubberizing the fabric in a calender, where the fabric moves in a given path to the calender, the spreader comprising a cantilever mounted mandrel having an outer generally cylindrical surface concentric with a rotational axis, with the cylindrical surface having a helical groove having convolutions with a pitch equal to a desired cord distribution laterally of the fabric; a mandrel support structure adjacent one edge of the fabric and having means for rotatably mounting the mandrel in a position transverse of the fabric with the cylindrical surface aligned with the fabric path to be generally tangential to a side of the fabric as the fabric moves in the given path; a first motor on the support structure for rotating the mandrel about the axis at a given rotational speed; a second motor for moving the support structure in a direction parallel to the rotational axis of the mandrel and at a given linear speed as the first motor is rotating the mandrel until a number of cords of the fabric at the one edge of the fabric are captured in the helical groove and spaced by the pitch of convolutions of the groove at a desired cord distribution; means for stopping the mandrel when the one edge is at a detected transverse location with respect to the mandrel support structure; and, feedback means for thereafter maintaining the one edge at a desired transverse location of the one edge.

45 Claims, 11 Drawing Sheets

SPREADER FOR CALENDAR LINE

The present invention relates to the art of spreading a reenforcing cord containing fabric preparatory to application of rubber to the fabric in a calender line and more particularly to a spreader and system using the spreader for controlling the width of fabric before entering a calender that rubberizes the fabric to produce sheet material used in the production of tires.

INCORPORATION BY REFERENCE

Incorporated by reference herein is Bulletin No. 10191 from North American Manufacturing Company entitled Calendar Lines "Total Concept" dated April 1991. This trade bulletin discloses a well known calender line for producing laminating fabric to be used in the manufacturing of tires. Disclosed herein are a number of devices for spreading the fabric which is formed from longitudinally extending, reenforcing cords spaced laterally across the fabric between two spaced edges. The fabric moves in a given path through the spreading devices and processing steps on its way to the calender where it is rubberized. This type of production line is well known and has been used for over quarter of a century. Bulletin No. 10191 is incorporated by reference herein to show the environment to which the present invention is directed which is a spreading mechanism located immediately before the calender where the fabric is encased in non-vulcanized rubber for production of tires.

BACKGROUND OF INVENTION

In the tire and rubber industry calender lines process "gray" fabric for the purpose of producing laminate sheets used to construct rubber tires. The fabric includes longitudinally extending reenforcing cords spaced laterally across the fabric between two transverse edges, which cords are held together by transversely extending picks including small strands or threads spaced longitudinally of the fabric. The fabric is unrolled and then treated in the calender line in a manner that requires periodic spreading of the fabric to a width which is carefully controlled as the fabric enters the calender. The tire cord fabric is produced with various cord counts per inch across the fabric, i.e. cord distribution. In some instances, the cord count or distribution is as low as twelve cords per inch; however, it can be as high as thirty cords per inch. These fabric cords are held together by the picks, which are woven perpendicular in the cords and spaced along the fabric with 2–3 picks per linear inch of cord. From a quality standpoint, the objective is to have the desired cord count extending uniformly over the entire width of the fabric before the fabric is introduced into the calender. However this even distribution of the cords is not accomplished in calender lines now in use. The fabric has a tendency to neck down as it travels toward the calender; therefore, the fabric must be respread several times in the calender line. Spreading devices heretofore used are not predicated on the cord count. As the fabric is respread periodically during its travel through the line, a greater number of cords remain bunched at the edges because the spreading devices are ineffective in spreading this portion of the fabric. Thus, a high concentration of cords appear adjacent the edges of the fabric as the fabric enters the calender for rubberization even though the fabric has the proper width. After processing by the calender, the edge portions of the fabric must be removed by a continuous cutting operation that results in a large amount of scrap with a corresponding reduction in yield for the calender line.

Typically, the outer three to five inches at the edges of the fabric are unacceptable because of an over concentration of cords. This particular problem has troubled the tire and rubber industry for many years. To date, the industry has not developed an automatic spreading device that controls the count of the cords across the fabric preparatory to the fabric entering the calender.

Static devices, such as spread bars, have been added to the calender line immediately adjacent the entrant end of the calender. These bars have two to four indexed positions and they must be manually shifted as a different fabric is being processed. Such devices cannot control width, are not automatic and substantially increase labor costs and down time when changing fabric being processed in the calender line. The most common spreader immediately adjacent the calender is a three finger spreader. This device generally spreads to width; however, the cord count across the fabric is not controlled. Feedback arrangements for use on three finger spreaders are difficult to control and sometimes result in splitting of the fabric.

Bowed roll spreaders are commonly used to spread the fabric to the desired width. Indeed, four or five spreaders of this type may be used before the fabric enters the calender. The three finger spreaders are located six to eight feet beyond the last bowed roll spreader since a bowed roll spreader can not be located close to the calender. Consequently, the fabric necks down after the last bowed roll spreader and before it enters the calender itself. For that reason, there is a need for a spreader to control fabric width immediately adjacent the entrant end of the calender. The three finger spreader is the device which is now commercially acceptable. Since a three finger spreader at this location can cause breakage of the picks and/or cords when using a feedback control, a fixed three finger spreader has been used to approximate the desired width of the fabric as it enters the calender. The only way to actually distribute the cord is the previously mentioned spreader bar that can be located immediately before the calender. This device is so labor intensive that it is not widely used. The operator must spread the fabric over the face of the bar before the line can be continuously operated. The calender lay down roll cannot be cleaned without removing the bar; therefore, the operator plays a substantial roll in a line which uses a spreader bar for distributing the cords prior to the calender. Thus, only width control devices have been used routinely in the tire industry for a calender line.

There has been, and still is, a substantial need for a device at the entrant end of the calender which can control the width of the incoming fabric while maintaining the desired cord count across the fabric and without damage to the fabric itself.

THE INVENTION

The present invention relates to a system for spreading the fabric before it enters the calender used in making rubberized tire laminating sheet material. In addition, the invention relates to a spreader for use immediately adjacent the entrant end of the calender and a grooved mandrel used in this novel spreader.

The fabric which is introduced into the calender has an upper and lower side, transversely spaced, parallel first and second edges and longitudinally extending tire reenforcing cords spaced laterally across the fabric between the edges. A system, according to the present invention, spreads this type of fabric preparatory to rubberizing the fabric in a calender as the fabric moves in a given path through a calender line to the calender so the edges of the fabric have a desired transverse location determining the desired width of the fabric entering the calender, while still maintaining an even distribution of cords across the fabric. The prior spreading devices were ineffective in correcting bunched cords at the edges of the fabric causing the edges to be scrap. The system of the present invention includes a pair of edge spreaders mounted on opposite sides of the fabric at the entrant end of the calender. Each of the edge spreaders includes a cantilever mandrel directed toward the center of the fabric, with an outer cylindrical surface concentric with a rotational axis. The mandrel is mounted so the outer surface of the rotating mandrel is generally tangential to a surface of the fabric, preferably the lower side of the fabric. The cylindrical outer surface of the rotatable mandrel includes a helical groove with convolutions having a pitch equal to the desired cord distribution laterally of the fabric. Each spreader includes means for rotating the mandrel to pull the cords onto the mandrel in the helical groove and means for moving the mandrel simultaneously inwardly under the fabric until the inward movement and rotation is stopped when the edge of the fabric moving along the groove of the mandrel reaches a position on the mandrel determined by a sensor carried with the support structure of the mandrel. The cord is pulled by the rotating groove on to the mandrel. In accordance with a further aspect of the present invention, the rotational speed of the mandrel is at a first rotational rate effectively advancing the groove outwardly one pitch in a selected time while the linear speed of the mandrel is at a second linear rate advancing the mandrel inwardly substantially less than one pitch in the selected time whereby the rotation and linear motion pulls the cords outwardly by the rotating groove. These two rates are relational in concept so that the mandrel is rotating and pulling the cords of the fabric at a rate faster than the mandrel is moving into or under the fabric. By accomplishing this relationship of the rotational speed and the linear speed, the cords are pulled slightly by the rotating mandrel in a manner to spread the fabric until the edge of the fabric is at a given position on the mandrel detected by a sensor on the mandrel support structure. At that time, the mandrel rotation is stopped and the support structure of the mandrel is moved linearly until the sensor on the mandrel support structure is at the desired location for the edge of the fabric. The width of the fabric is then controlled by rotation of the mandrel or linear movement of the mandrel carrying the captured cords. In practice, the second linear rate is approximately 0.60–0.90 of a pitch. Thus, the edge of the fabric determined by the first captured cord is moved outwardly at a ratio equal to 1:0.6 to 1:0.9 as the mandrel is moved inwardly. In practice, the ratio is 1:⅔. The edge spreader including the rotating grooved mandrel must first capture the edge of the fabric by the combined rotational and linear movement of the mandrel until the fabric is on the mandrel about 2–5 inches. Thereafter, movement of the mandrel is used for width control preparatory to the fabric being introduced into the calender. Preferably this movement is rotation of the mandrel; however, it could be done with linear movement of the mandrel. A standard feedback control using an error amplifier senses the position of the edge and moves the mandrel to maintain the edge at a location to control width of the fabric. To start a new fabric, both mandrels can be retracted. This is an advantage over the prior art spreader bars which had to be manually indexed between each fabric being run by the calender line. The next fabric is spliced to the fabric being processed. This causes a substantial reduction in width which is handled by the novel edge spreader by capturing of the cords and then moving the mandrel to its final operative position.

During the cord capturing mode of the mandrel, it is being rotated and moved laterally or linearly. A bowed spreader approximately 6–8 feet before the novel edge spreaders of the present invention is preset to a width of less than the desired final width of the fabric passing through the calender. In this manner, the fabric as it is being first introduced into the calender line comes to the novel edge spreaders of the present invention at a slightly narrowed width. The control positions of the edge is one to two inches inward of the final positions. The reduced width of the incoming fabric allows the rotating grooved mandrels of the novel edge spreaders to move inwardly to a desired position determined by the fabric width being processed and then rotated and moved linearly to capture the cords in the outer two to five inches of fabric and pull the cords outwardly. If the bowed spreader were at the desired width, the cords would not be pulled. By having a differential in the ratio of rotation based upon the count distribution of the fabric and the linear movement of the mandrel inwardly, the fabric is spread until the edge is detected by a standard H3111 detector mounted adjacent the rotating mandrel on the mandrel support structure. When this edge is detected to be in the right position on the mandrel, the mandrel is stopped so that it no longer rotates. Thereafter, the linear movement mechanism of the mandrel is used to pull the fabric to the final desired position. The edge, as detected by the sensor on the mandrel support structure, is maintained at this position by a standard feedback arrangement including an error amplifier that creates an error signal determined by the position of the edge of the fabric during the calendering operation. The error amplifier and adjusting mechanism or system for rotating the mandrel or for moving the mandrel in and out laterally to maintain the edge at the desired position for controlling the width of the fabric is not a part of the present invention since standard feedback technology is employed.

The invention relates to the concept of using a rotating mandrel having a helical groove with a pitch determined by the desired cord distribution in cords per inch across the fabric. The mandrel is movable directly under the fabric to capture the cords and move them in a thread fashion over the top of the mandrel as the mandrel is moving forward toward the center of the fabric. If the ratio of rotation to lateral movement is 1:1, the actual transverse position of the edge of the fabric would not change and the rotational movement of the mandrel will merely "screw" under the fabric and capture the edge of the fabric. Distribution of the cords at the edge of the fabric would be at the desired distribution for the cords. Rotation would stop when the mandrel "screws" under the fabric a distance sufficient to bring the fabric on to the mandrel until its edge is sensed by a sensor on the mandrel support structure. This concept is novel and has substantial advantages; however, by changing the ratio of linear movement to rotational movement, the cord is pulled outwardly and the fabric is spread during the capturing action of the rotating mandrel. This pulling action during the initial capture mode has a distinct advantage. The cords in front of the advancing mandrel do not bunch. Any slight bunching action in front of the advancing mandrel is distributed by pulling the mandrel outwardly after capturing the edge cords.

By employing two edge spreaders using the rotating, grooved manual concept, the edges of the fabric immediately adjacent the entrant end of the calender are captured and the desired cord distribution is maintained at the edges of the fabric. This is a distinct advantage over the prior art. To facilitate fabric change over, the invention contemplates an additional mandrel or mandrels mounted on the spreader.

A rotating turret or other indexing mechanism carries a second mandrel so a mandrel having a different pitch for the helical groove is on stand-by. As the fabric has been run through the calender line and a next fabric is to be processed, the edge spreaders are merely moved outwardly. The turret is indexed to position a new mandrel for the next fabric. Thereafter, the fabric capturing mode is repeated for the second fabric spliced to the tail end of the existing fabric. The first mandrel may be removed and replaced by still a third mandrel or the first used mandrel may remain on the turret and be the stand-by mandrel if the first fabric is to be processed next. To assist the rapid conversion of the novel edge spreaders to a different mandrel, the mandrel with various grooves are each provided with a quick disconnect at the driving spindle on the spreader. In less than two minutes, a new mandrel can be placed in position awaiting the next fabric to be run by the calender line. Another aspect of the present invention is the mandrel itself which is a custom made component for fabrics having a specified cord distribution. The mandrels are purchased and stocked for subsequent use on the new spreader.

The novel edge spreader with the rotating grooved mandrel is located immediately adjacent the calender and functions in concert with a fall width spreader that is upstream. Each of the edge detectors on opposite sides of the fabric are independently controlled to position the edges of the fabric for maintaining the desired width and position of the fabric entering the calender. The grooved mandrel is approximately eight inches long and is cantilevered from a motorized housing or support structure. The housing, or support structure, is mounted to a frame fixed to the side of the calender frame to allow approximately twenty-four inches of linear travel of the mandrel support housing or support structure. A standard H3111 detector by North American Manufacturing is used to detect the edge of the fabric and is fixed to the mandrel support structure. A linear or axial transducer is employed for determining the linear position of the mandrel support structure on the fixed frame. This transducer is a standard axial position transducer that allows the mandrel support structure to be moved to a home position for a given fabric before the capturing cycle is initiated. Then this transducer is used to move the mandrel support structure so its edge sensor (H3111) is at the desired edge position for width control as the fabric is in a normal run. A drive motor rotates the mandrel and a second motor positions the mandrel support structure on the fixed frame to move the support structure to the home position, shift to capture mode to capture the cords on the mandrel, and then shift to the width control mode using standard edge control, feedback technology, in a desired sequence.

The mandrel has a helical groove with a pitch that is close to the ideal cord spacing or distribution for the fabric being captured and width controlled. In practice, the mandrel grooves are more coarsely spaced than the ideal cord spacing for the fabric being processed. The novel mandrel is attached to the drive motor with a quick change mechanism to expedite set up for different cord counts. The mandrel grooves are polished and are preferably hardened to protect against wear. The depth of the groove on the mandrel is approximately the diameter of the reenforcing cords; however, a lesser depth is possible.

After a new fabric is spliced into the calender line, the fill width spreader before the edge spreader of the present invention is commanded to spread the new fabric to a width, which in the preferred embodiment, is slightly less than the ultimate desired width for the fabric being processed. When this slightly less width is reached, a command signal is generated to trigger operation of the edge spreaders. A motor engages and drives the grooved mandrel causing it to rotate at a predetermined fixed rotational speed at a first rate. At the same time, another motor rotates an axial lead screw to move the mandrel laterally or linearly toward the center of the fabric. Consequently, the rotating mandrel is advanced toward the edge of the fabric in a position whereby the plane of the fabric is approximately tangential to the root diameter of the grooves on the rotating grooved mandrel. The leading edge of the mandrel is tapered so that the cords slide up the taper and are then threaded into the helical groove of the mandrel. The rate of axial or linear movement is coordinated with the rate of the rotational speed of the mandrel in a manner that is proportional. The mandrel advances into the fabric at a rate which is consistent with the pitch of the rotating mandrel. In practice, the rate of the linear movement is slightly reduced compared to the rotational rate of movement of the mandrel. In this manner, the fabric is spread as it is pulled by the rotating groove, which groove is rotating proportionally faster than the advancing speed of the mandrel. Stated another way, the rotational speed of the mandrel pulls the cord outwardly at a linear speed. This linear speed is greater than the inward movement linear speed of the mandrel caused by a second motor. These two speeds are coordinated to prevent excessive lateral forces on the fabric that could cause the cords to jump from the grooves as they are being pulled outwardly by rotation of the mandrel. The advancement of the mandrel into the fabric continues until the outermost fabric edge is sensed by a standard edge sensor or detector on the movable mandrel support structure. The sensor is located such that about two to five inches of fabric is threaded on the mandrel when the edge is detected by the sensor. The rotation of the mandrel is stopped and the axial movement of the lead screw is reversed to pull the mandrel outwardly toward the side frame of the calender. The fabric is thus carried by the mandrel assembly which is now stationary. This causes a spreading of the fabric while maintaining the cords separated at the edge portion as established by the adjacent convolutions of the helical groove in the mandrel.

An axial transducer is employed to determine when the mandrel assembly has reached a position that is consistent with the sensor on the mandrel support structure being the target width of the fabric. At that time, the mandrel support structure is parked in position. Control then reverts to the edge sensor mounted on the mandrel support structure. Should the fabric jump out of the grooves the sensor will cause the mandrel to rotate thereby screwing the fabric back into the proper position. Should the fabric become overspread, the mandrel will rotate in the opposite direction thereby unscrewing the fabric to a smaller width. This same action could be accomplished by the linear motor moving the mandrel support structure back and forth to control the desired position of the edge at the proper position. However, this would require an edge sensor that does not move with the mandrel support structure. In other words, either the mandrel can be rotated back and forth to control the edge position, which is used by the invention, or the linear motor can be moved back and forth to control the edge position. This width control is after the cord has been captured and detected to be at a desired position on the mandrel. The spreader then operates merely to control the edge position on both sides of the fabric to the desired position for width control. This can be done by rotating the mandrel in opposite directions or by moving the support frame of the mandrel laterally in both directions. In either manner, an edge sensor together with the linear transducer are used to create an error signal that properly adjusts the spreader to control the desired position of the edges of the fabric as it enters the calender.

The primary object of the present invention is the provision of an edge spreader, a system of using the edge spreader and a method of using the edge spreader, which spreader, system and method allow accurate width control of a fabric entering a calender, without bunching of the cords in the edge portion of the fabric.

Another object of tile present invention is the provision of a spreader, system and method, as defined above, which spreader, system and method substantially reduce the amount of scrap in the rubberized fabric being processed in a standard calender line of the type used in producing tire making rubberized material.

Still a further object of the present invention is the provision of a spreader, system and method, as defined above, which spreader, system and method operates automatically and requires only a short time and no appreciable manual labor at the entrant end of the calender.

Still a further object of the present invention is the provision of a spreader, system and method, as defined above, which spreader, system and method is an automatic machine designed to provide substantially improved cord count on the outermost 3–5 inches at the edge of a fabric comprising rubberized longitudinally extending cords of the type used in the production of tires.

A further object of the present invention is the provision of a spreader, system and method, as defined above, which spreader, system and method includes a cantilevered grooved mandrel which is rotated and moved inwardly to capture the cords of the fabric and then used to control the final width of the fabric as it enters the calender. The mandrel has a helical groove and is rotated and proportionally advanced in a manner that "screws" the fabric onto the groove without excessive lateral force on the fabric as it is being pulled to the desired position on the mandrel and then maintained at the desired width for entry into the calender for rubberizing of the fabric.

Yet another object of the present invention is the provision of a sensor, system and method, as defined above, which sensor, system and method involves sensors and axial position transducers that determine the relative position of the edge of the fabric and compares this position to the target width or desired width of the fabric and also determines the amount of fabric engaged on the mandrel groove for the subsequent controlling operation.

A further object of the present invention is the provision of a spreader, system and method, as defined above, which spreader, system and method employs dynamic means, such as an error amplifier, for monitoring the edge of the fabric after the fabric has been captured on the mandrel of the spreader and the concept of screwing or unscrewing the cords to control the desired width of the fabric.

These and other objects and advantages will become apparent from the following description taken together with the accompanying drawings.

PREFERRED EMBODIMENT OF THE PRESENT INVENTION

Figure 1:
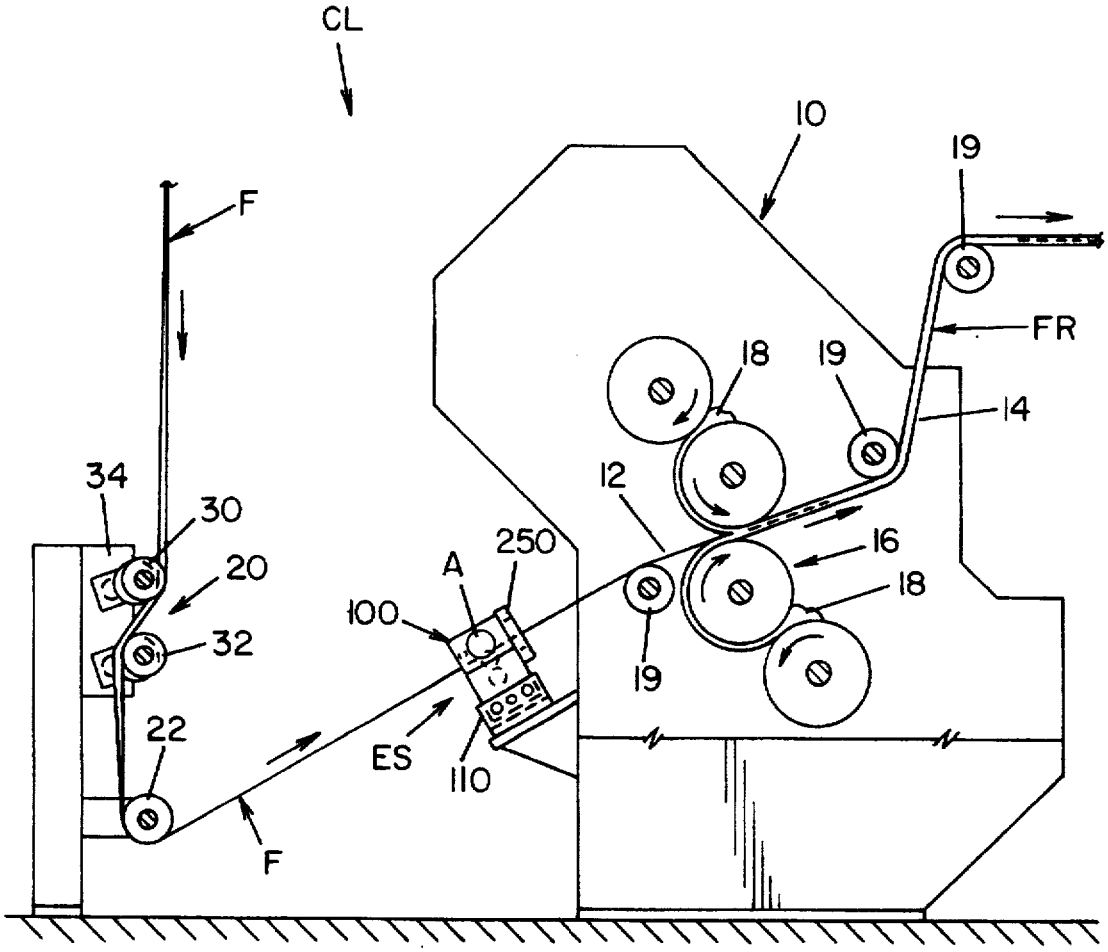
FIG. 1 is a side elevational view of the calender section of a calender line with the present invention located at the entrant end of the calender.
Figure 2:
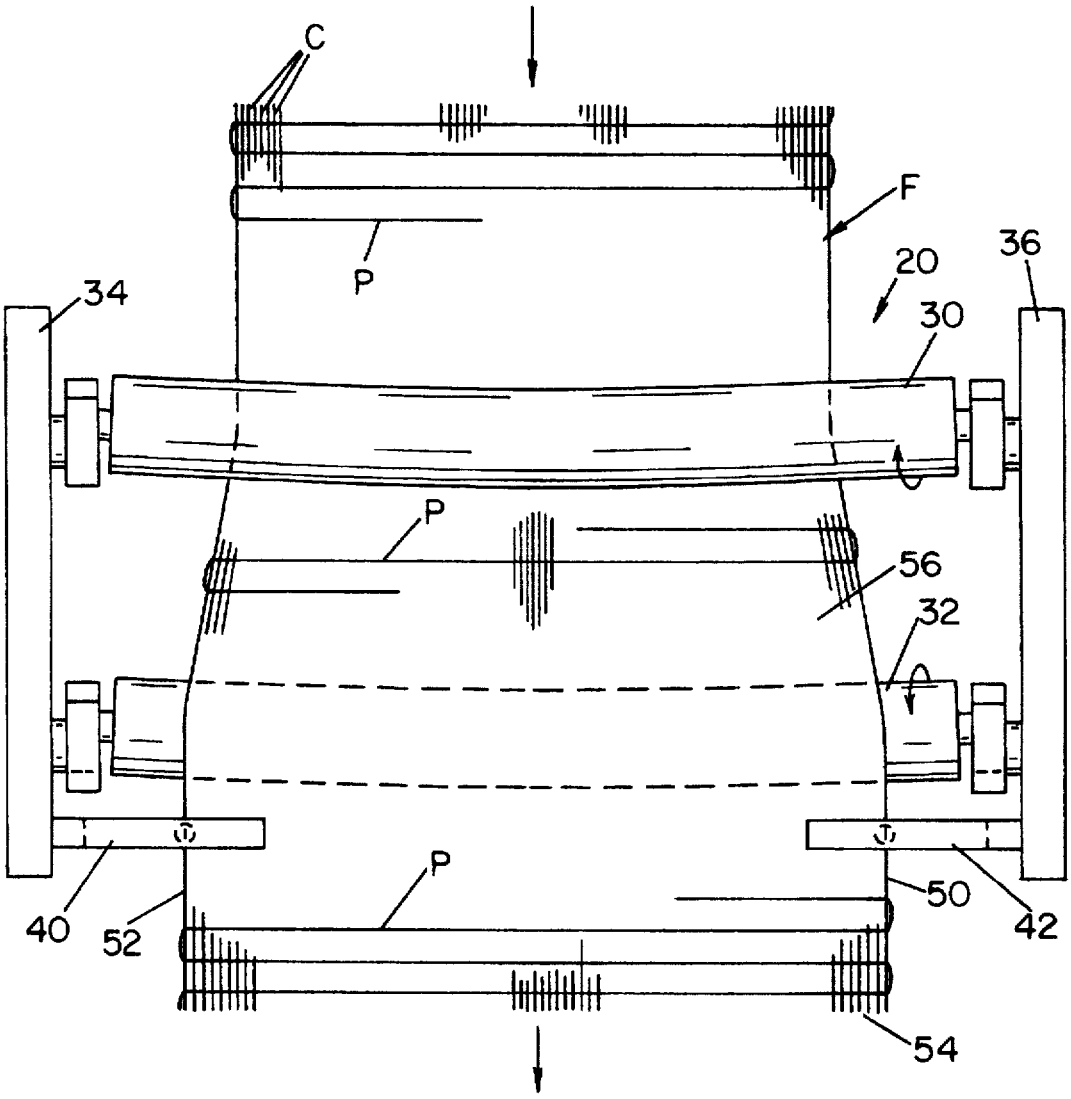
FIG. 2 is atop plan view of the bowed spreader spaced upstream of the invention for spreading the fabric as it enters the area controlled by the present invention.
Figure 3:
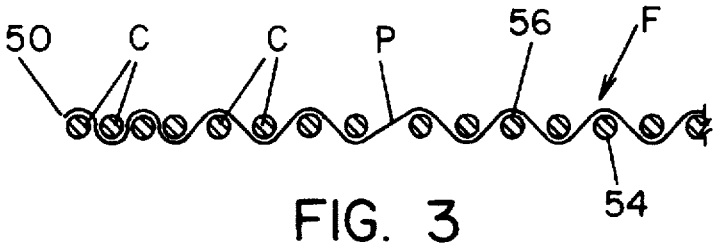
FIG. 3 is a schematic partial cross-sectional view illustrating the edge portion of the fabric as spread by the bowed spreader shown in FIG. 2.
Figure 4:
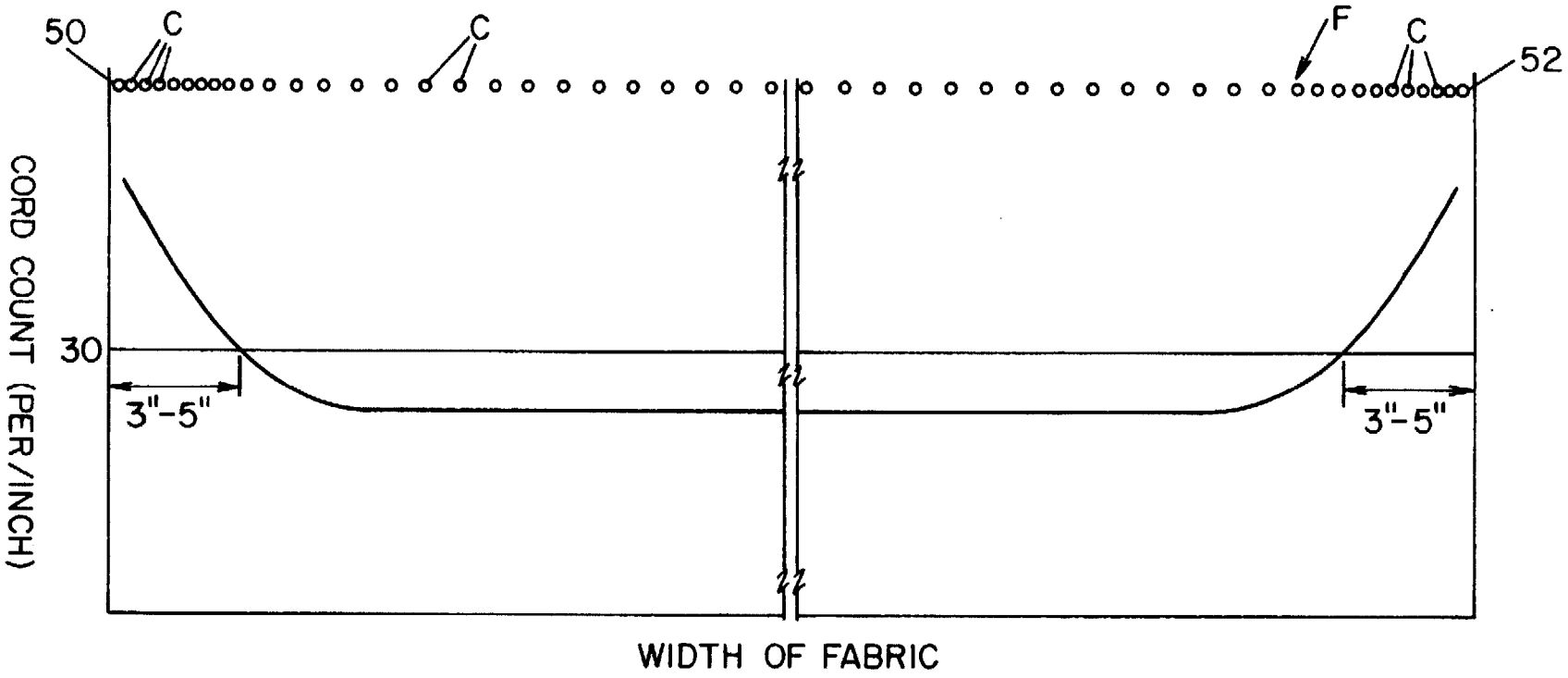
FIG. 4 is a graph showing cord distribution across a fabric and illustrative of the distribution when a width spreader is employed without controlling the distribution of the cords in the edge portions of the fabric.

Referring now to the drawings wherein the showings are for the purpose of illustrating preferred embodiments of the invention only and not for the purpose of limiting same, FIG. 1 shows a calender line CL with a calender 10 for rubberizing a fabric F into a rubberized fabric or sheet FR for the purposes of manufacturing tires. In accordance with standard practice, calender 10 has an entrant end of entrant or nip 12, an exit end 14 and roll stacks 16 for applying rubber 18 onto fabric F as it moves through the calender in a path determined by guide rolls 19. Six to eight feet prior to entrant end 12 of calender 10 there is provided a width control bowed spreader 20 for spreading fabric F to a controlled width for delivery to the calender around guide roll 22. In the past, a three finger spreader was used between guide roll 22 and entrant end or nip 12. In this manner, a final somewhat uncontrolled spread was applied to fabric F before it entered the calender. In accordance with the present invention, a novel edge spreader ES is provided on both outside edges of fabric F immediately before nip 12. Only one of the edge spreaders is shown in FIG. 1; however, each of the edge spreaders is identical and perform a function which will be explained when disclosing the aspects of the present invention. In operation, spreader 20 attempts to spread fabric F to the known desired width, after which it is spread by transversely spaced edge spreaders ES and is then rubberized to form fabric FR. The bowed spreader 20 is illustrated in FIG. 2 as including bowed rolls 30, 32 with transversely spaced supports 34, 36 and outlet edge sensors or detectors 40, 41 such as North American edge detectors H3111. An appropriate standard feedback arrangement uses the detected position of edges 50, 52 of fabric F to control the bowed amount of rolls 30, 32 so that the outlet fabric has edges 50, 52 spread to the desired position, or known desired transverse locations, consistent with the desired width of fabric F as it progresses toward calender 10. Fabric F not only has transversely spaced edges 50, 52 but also a lower side or surface 54 and an upper side or surface 56 to define the boundaries of longitudinally extending tire reenforcing cords C spaced laterally across the fabric between edges 50, 52 preparatory to rubberizing fabric F in calender 10 as the fabric moves in a given path illustrated in FIG. 1 to the nip of calender 10. Each different type of fabric F has a preselected cord distribution, normally in the range of ten to thirty cords per transverse inch, and the cords C are held together by a thread or pick P woven through the cords at a distribution of 2–3 picks per inch in the longitudinal direction. At roll 22, spreader 20 attempts to arrange edges 50, 52 of fabric F in the proper spacing to control the width of the fabric as it is directed to the calender. Since the spreading of the fabric by bowed roll spreader 20 involves merely controlling width, cords C tend to bunch at edges 50, 52, as shown in FIGS. 3 and 4. The cord distribution for the spread fabric is shown in the upper portion of FIG. 4 where the graph illustrates that the actual cord distribution adjacent edges 50, 52 is greater than the desired cord distribution which, in the illustrated embodiment, is thirty cords per inch. Due to the spreading action of the spreaders upstream of spreader 20 and spreader 20 itself, the central portion of fabric F has a cord distribution slightly less than the desired distribution. The center portion is not a real problem; however, the bunching of cords C at edges 50, 52 does produce scrap which must be trimmed from strip FR as it leaves calender 10. In the prior art, a three finger spreader was also merely a width controlling device and did not solve the problem of cords bunching at the lateral edges. Width control has a tendency to maintain high cord counts at the edges subsequent to the spreading action. Spreader bars used for spreading the cords required high labor costs and substantial down time between fabrics and did not present a satisfactory solution to the problems causing large amounts of edge scrap in calender lines of the type to which the present invention is directed.

Figure 5:
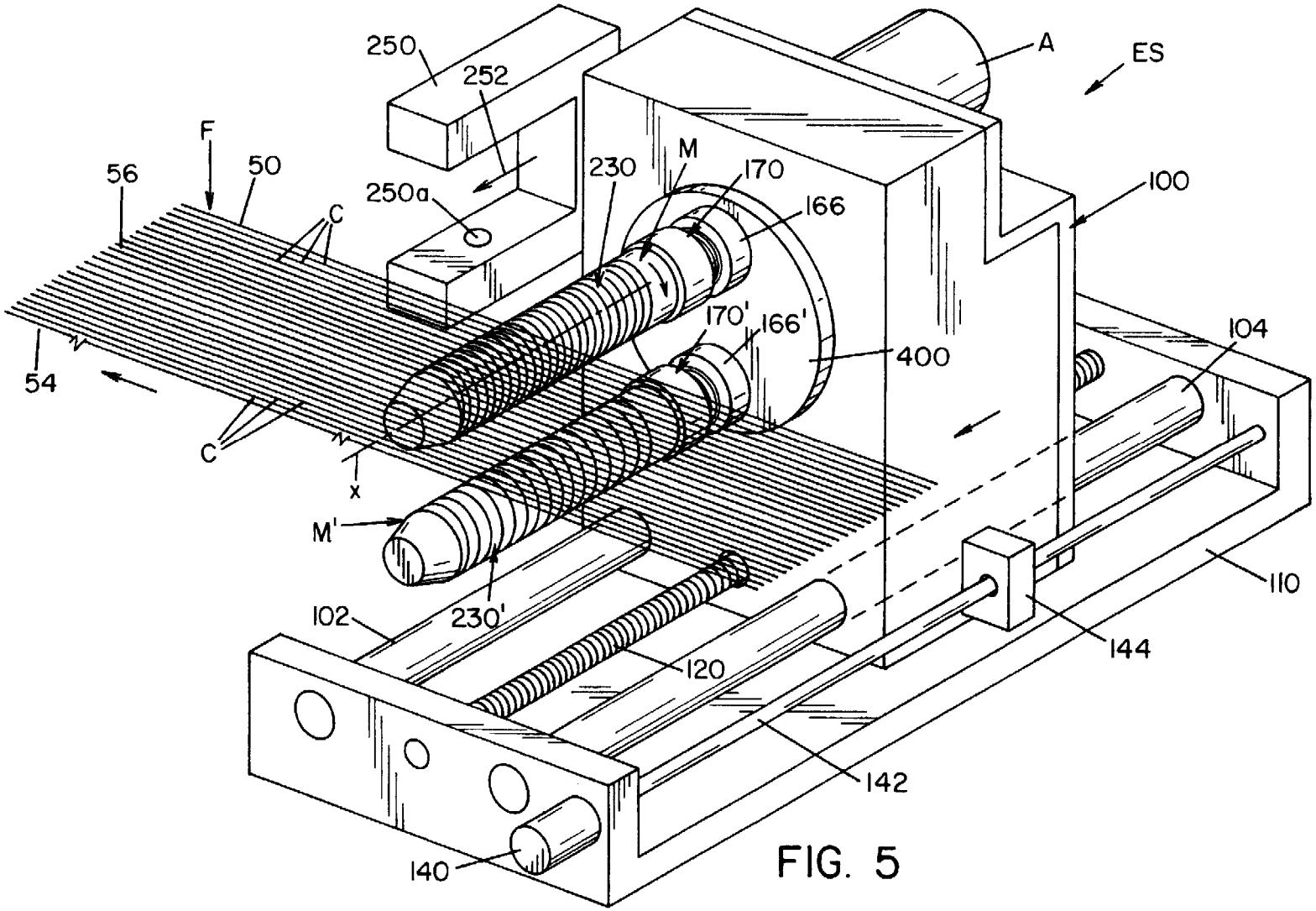
FIG. 5 is a pictorial view of an edge spreader constructed in accordance with the present invention.
Figure 6:
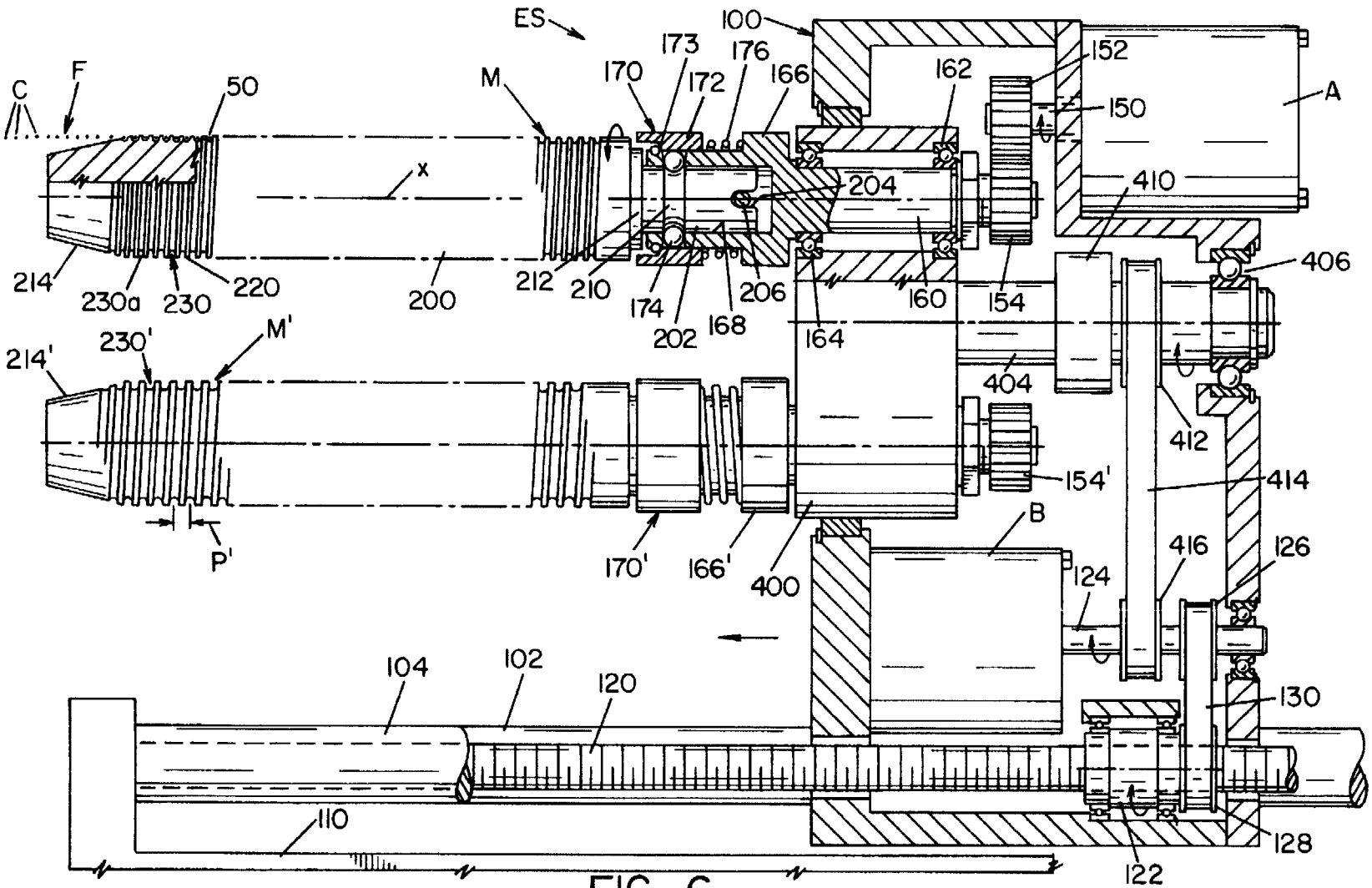
FIG. 6 is a cross sectional view of the preferred embodiment of the present invention as illustrated in FIG. 5.
Figure 7:
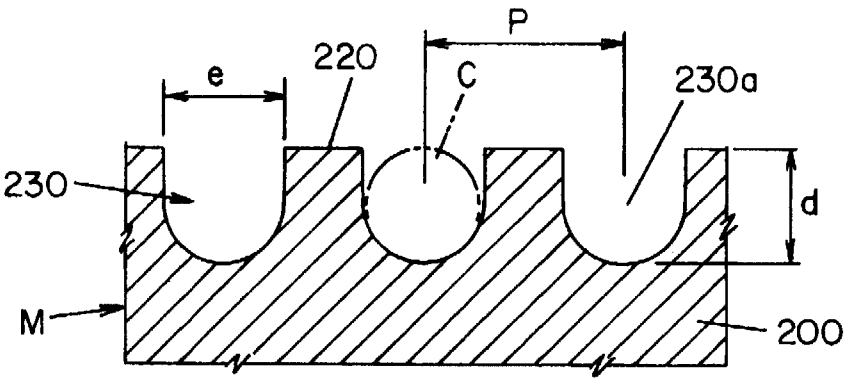
FIG. 7 is a cross sectional view of a portion of the grooved mandrel, enlarged for showing aspects of the mandrel in more detail.
Figure 8:
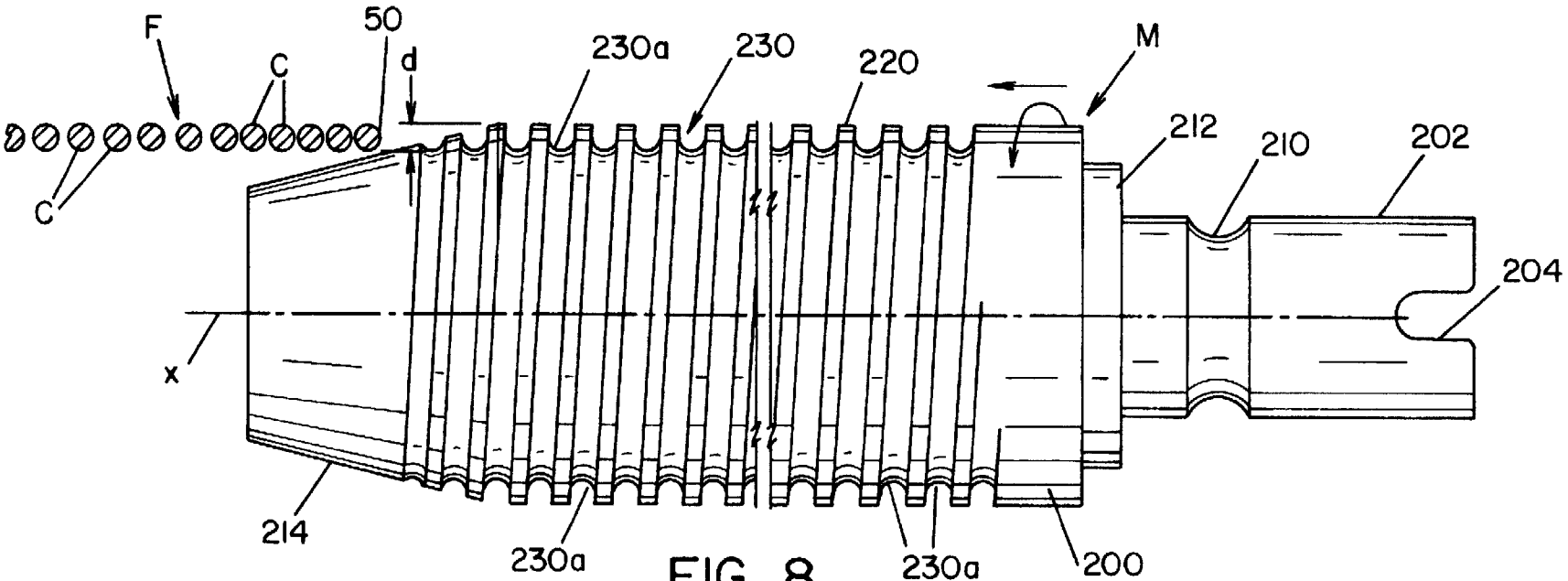
FIG. 8 is a side elevational view of the grooved mandrel as it approaches the fabric in the capturing mode of operation which mandrel is a separable sub assembly.
Figure 9:
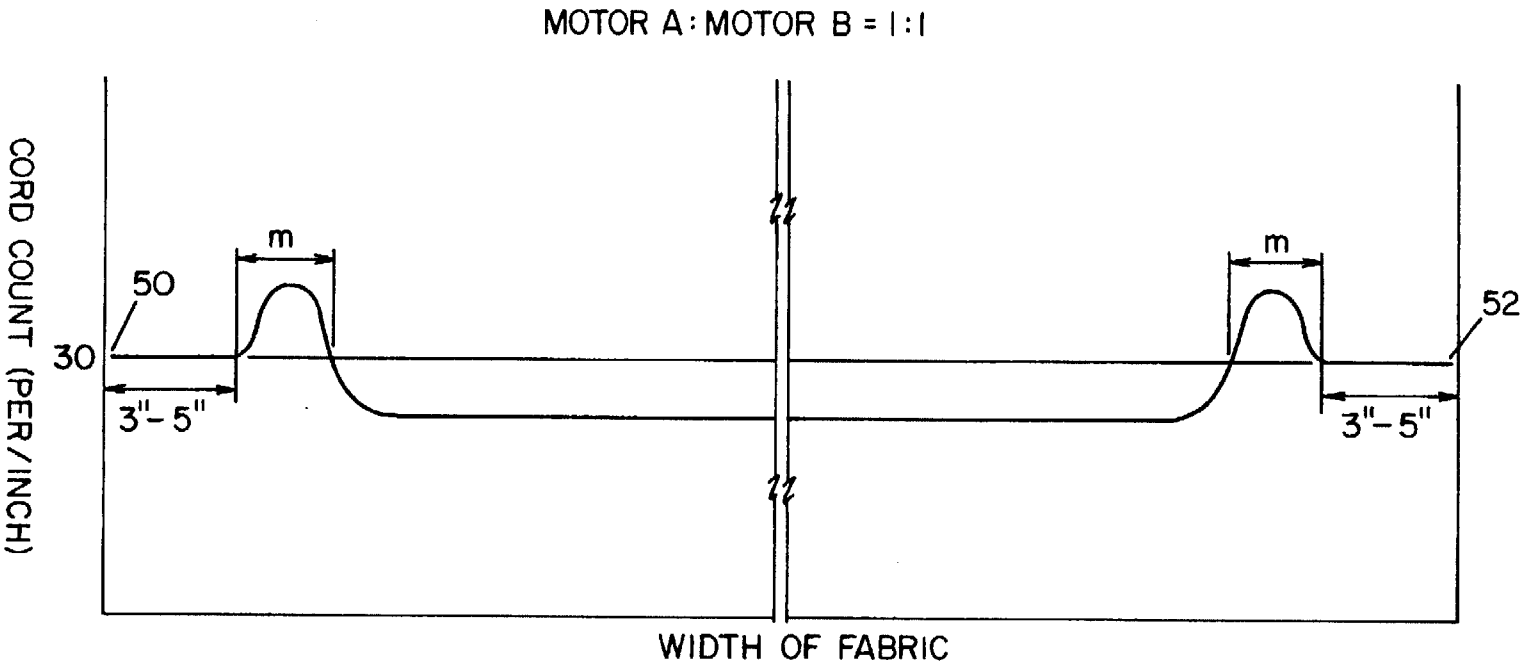
FIG. 9 is a graph similar to FIG. 4 illustrating operation of the preferred embodiment of the invention when the inward linear rate of movement of the mandrel is coordinated with the rotational speed of the mandrel for a given cord count or distribution wherein the rotational and linear rates have a ratio of 1:1.
Figure 10:
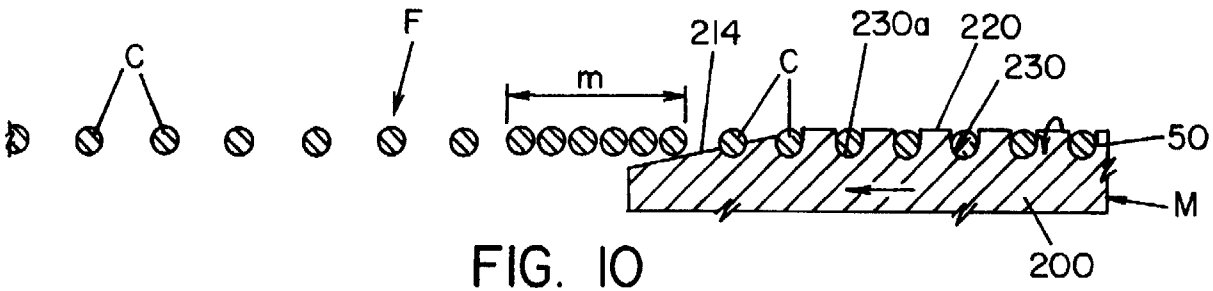
FIG. 10 is a side elevational view showing a part of the inwardly moving, rotating mandrel as it is capturing the edge cords of the fabric in accordance with the speed of relationship illustrated in the graph of FIG. 9.

Referring now to FIGS. 5 and 6, mandrel M is rotatably mounted on support frame or structure 100 which is laterally movable on a base 110 by sliding action on transversely spaced rods 102, 104. To move support structure 100 toward fabric F, or away from fabric F, a lead screw 120 is engaged by a rotatable nut 122 driven from shaft 124 of motor B through pulleys 126, 128 and a timing belt 130. An axial or linear transducer 140 has a transversely extending sensing rod 142 with a positional pick-up 144 mounted on support structure 100. The linear position of pick-up 144 is sensed by rod 142 and is transmitted to the microprocessor controlling spreader ES. During normal operation, motor B rotates nut 142 driving support frame or structure 100 toward or away from fabric F. To rotate mandrel M, there is a motor A, best shown in FIG. 6, wherein a shaft 150 drives gear 152 that is meshed with gear 154 to drive spindle 160 rotable supported in axially spaced bearings 162, 164 and having an outwardly extending rotatable head 166 with a central mounting bore 168. To connect mandrel M rotatably on support structure 100 there is provided a standard quick connect device 170 including a ring 172 with a conical cam 173 that coacts with balls 174 and is forced to the left by spring 176. Snap ring 178 limits the left hand movement of ring 172 caused by spring 176. Mandrel M includes a body portion 200 having a rearwardly extending mounting shaft 202 with a driving slot 204 coacting with pin 206 in bore 168 of spindle 160. A cylindrically extending groove 210 is provided on shaft 202 rearward of collar 212 for receiving balls 174 of quick connect device 170. In operation, ring 172 is forced to the right against spring 176 so that balls 174 can move outwardly beyond cam 173. This releases the balls from groove 210 so shaft 202 can be removed from mounting bore 168. The reverse action is accomplished for holding the mandrel in place. Pin 204 is rotated by motor A to rotate mandrel M about its central axis x which is the center of the outer cylindrical surface 220 of the mandrel. This outer cylindrical surface includes a helical groove 230 best shown in FIGS. 7 and 8. Groove 230 defines axially spaced convolutions 230*a* having a depth d, which is no greater than the diameter of cords C, and a width e which is generally equal to, but slightly large than, the diameter of the cords. Convolutions 230*a* have an axial spacing or pitch P corresponding to the cord distribution of the fabric being processed by the calender line. In the illustrated embodiment, the cord distribution is thirty cords per inch which provides a pitch of 1/30 of an inch. As shown in FIGS. 6 and 8, rotation of mandrel M by motor A as motor B moves the mandrel forward by moving structure 100, to capture the cords in edge 50 of fabric F as this edge is engaged by tapered nose 214 of mandrel M. Cords C progress along tapered nose 214 into groove 230. Continued rotation of the mandrel pulls the cords forward into groove 230, as illustrated in FIG. 10. By moving mandrel M forward while rotating the mandrel, cords C are captured in helical groove 230 as the mandrel is moved forward toward the fabric. If the rotational rate of speed of mandrel M is greater than the corresponding rate of linear movement of the mandrel, rotation of the mandrel pulls the cords to the right, as shown in FIGS. 6 and 8. If the rate of rotation and the rate of linear movement are coordinated at a 1:1 ratio, as shown in the graph of FIG. 9, the edge 50 remains stationary as mandrel M is screwed under fabric F. As will be explained in the preferred embodiment of the invention, the rate of the inward linear speed is less than the coordinated rate of rotational speed so that there is an outward pulling action on the cords at edge 50. This pulling action evenly distributes the cord over the top of mandrel M and move the edge 50 to the right. Movement of the fabric edge 50 to the right over mandrel M ultimately brings this edge into the view of detector 250, which detector in practice is an H3111 manufactured by North American. When edge 50 is detected by detector 250 to be in a given position, an output signal is created on line 252 in accordance with standard practice. This signal is created even though the rate rotational speed is coordinated with the rate linear speed at a ratio of 1:1 so the mandrel merely moves under the edge 50 and the edge does not move to the right. When the speed rates are intentionally different, the mandrel moves toward the fabric and the fabric is pulled over the cylindrical surface of the mandrel. In either instance, ultimately edge 50 is detected by detector 250 to create a signal in line 252. When that occurs, motor A is stopped and held stationary. Motor B is reversed to pull edge 50 to the right to the desired position of this edge as determined by the axial transducer 140. Based upon the signal from axial transducer 140, Motor B shifts structure 100 to the right with respect to fixed frame 110, until the location of edge 50 detected by detector 250 is at desired position of edge 50 for the proper width of fabric F as it enters into the calender. After structure 100 is shifted under the control of axial transducer 140 until detector 250 is located at the proper position to control the desired width of fabric F, detector 250 is then used as a standard edge detector for monitoring and controlling the width of fabric F. This is accomplished by rotating mandrel M clockwise or counterclockwise when edge 50 deviates from the proper position as sensed by detector 250. The direction of rotation moves edge 50 inwardly or outwardly to control the edge to the set position of detector 250 during normal operation of the spreader ES. A separate spreader is located on both edges 50, 52 of fabric F to control the width by the control of the positions of edges 50, 52.

Figure 5A:
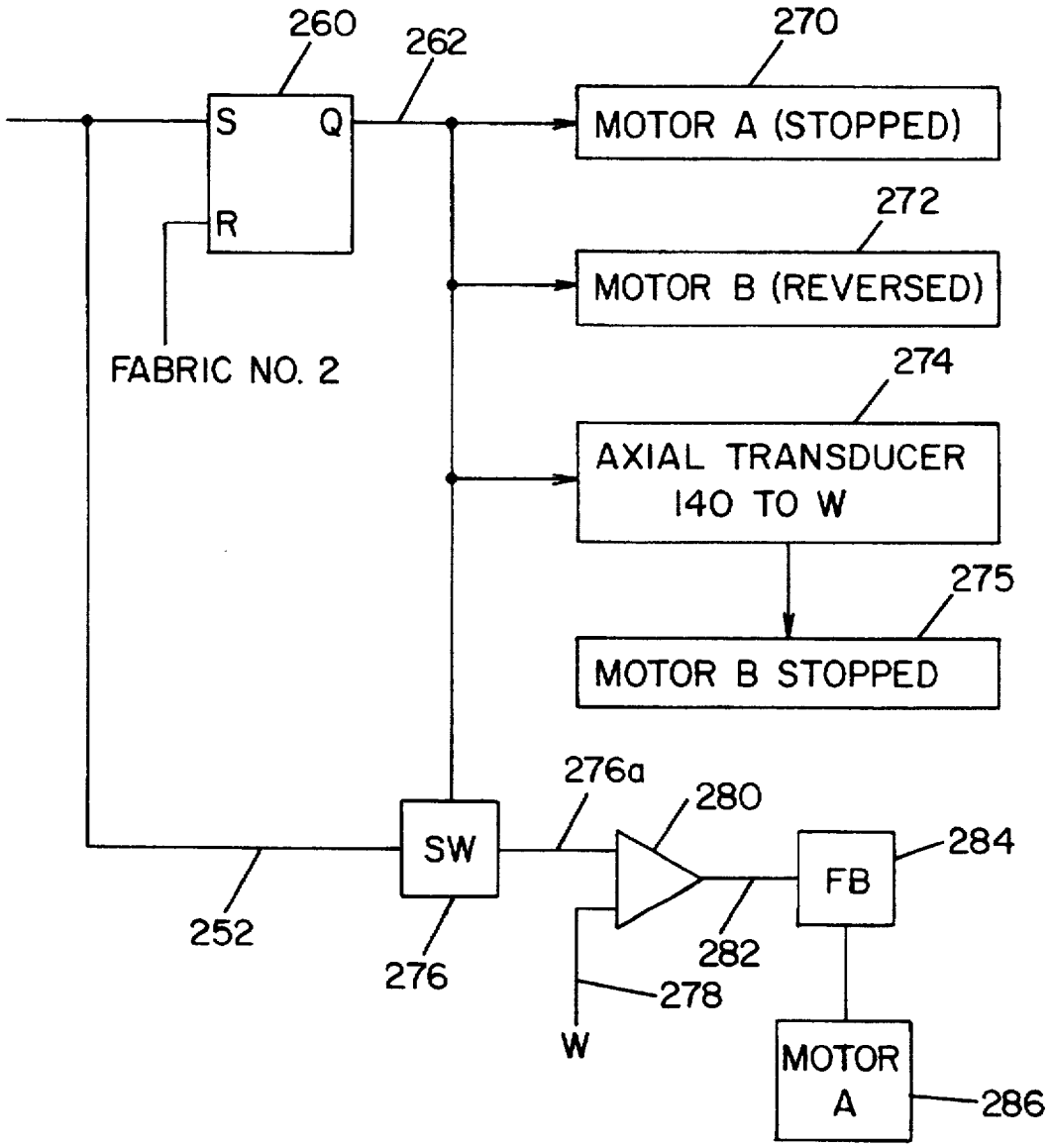
FIG. 5A is a block diagram showing a logic network for shifting the present invention, as illustrated in FIG. 5, between a capturing mode of operation and a spreading mode of operation for width control.

Control of the two spreaders ES is by a microprocessor or PLC. A schematic block diagram of the overall operating characteristics of the spreader, as so far described, are shown schematically in FIG. 5A. During the capturing mode of operation mandrel M is rotated by motor A and motor B shifts the mandrel forward at a reduced rate until edge 50 reaches the setting of opening 250*a* detector 250 to create a signal in line 252. This sets flip-flop 260 to create a logic 1 in output 262. The logic 1 in line 262 stops motor A so mandrel M is not rotating, as indicated by block 270. At that time, motor B is reversed as indicated by block 272. This action pulls the cords captured on mandrel M and starts spreading of the fabric. This operational step is used in practice because when a new fabric F is spliced into the calender line, it has a necked down width substantially less than the desired final width W for the fabric as it is to be introduced into calender 10. Thus, during the initial capture mode of operation for a new fabric, mandrel M is "screwed" into the fabric until the edge is detected and then rotation is stopped and mandrel support structure 100 is moved outwardly to a desired position. The desired position is indicated by block 274 wherein axial transducer 140 determines that the detection point of detector 252 is at the desired position to control the width W of fabric F for a given fabric. Thereafter, transducer 140 stops motor B as indicated by block 275. Fabric F has been stretched and is ready for continuous, normal width control, which is accomplished with cords C properly spaced at the edge portions of the fabric. The cords are not bunched at edges 50, 52. This is a concept not heretofore accomplished in the art. To maintain or monitor width W during normal operation of calender line CL, a software switch 276 directs the analog signal on line 252 to the output line 276*a* at the input of error amplifier 280. The other analog input to the error amplifier is the desired width W providing a representative analog signal in line 278. Thus, the output 282 of error amplifier 280 is the difference between the detected position of edge 50 at detector 250 and the known desired location for this edge to control width W of fabric F. Error amplifier 280 is directed to a feedback mechanism 284 for controlling the direction of rotation of the mandrel by way of motor A as indicated by block 286. Thus, after edge 50 has been captured by mandrel M and mandrel support structure 100 has been moved to the desired position, a standard error amplifier feedback control system is used to control the position of edge 50 by rotating mandrel M in the proper direction to regulate the actual position of edge 50. Of course, edge 50 could be controlled by moving mandrel M linearly; however, this would require detection of the actual position of the edge by a detector not movable with structure 100. In such a system, the actual position of the edge is detected and used for a feedback system to maintain width W.

The invention is the use of a rotating grooved mandrel M which captures the edge of the fabric in a manner that maintains cords C spread in the desired distribution pattern. If the rotational speed and linear inward speed used during the capturing mode are coordinated on a 1:1 basis, edge 50 stays in the same general lateral position and the bunched cords C at the edge 50, area m, are merely moved forward ahead of the mandrel as shown in FIGS. 9 and 10. This does allow edge 50 to be captured properly on mandrel M and held in the proper spacing during the spreading operation. Thus, the rotating and moving mandrel to capture the edge cords presents an advantage heretofore not obtainable in purely width controlled spreaders. However, as will be described with respect to FIGS. 12–14 the preferred embodiment accomplishes a further improvement over the basic advantage of the present invention by rotating the mandrel more rapidly than a coordinated linear movement of the mandrel. This improvement has been described and will be explained in more detail with respect to FIGS. 12–14.

Figure 11:
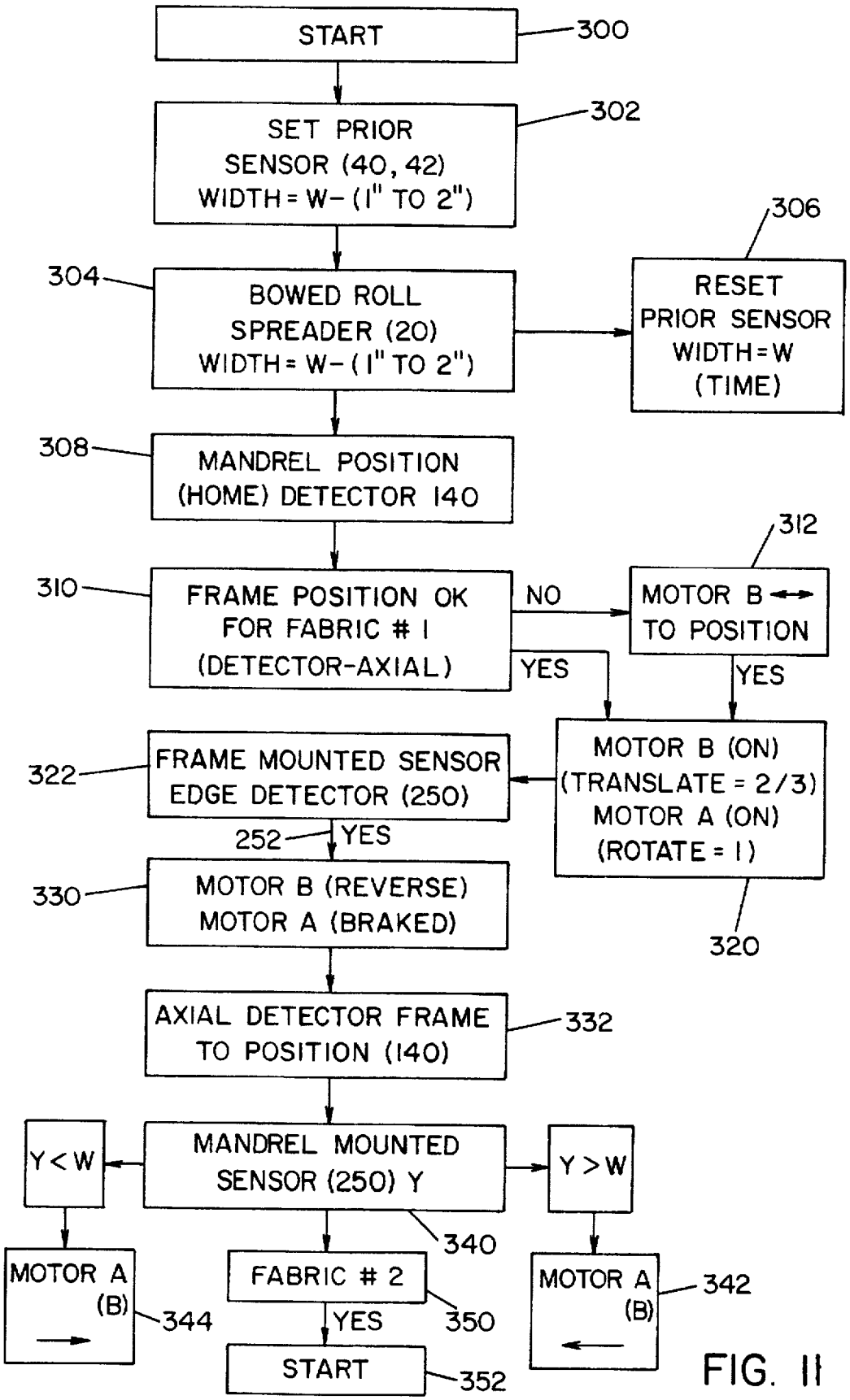
FIG. 11 is a block diagram showing the operating characteristics of the preferred embodiment of the present invention with certain optional characteristics.

Referring now to FIG. 11, a flow chart is shown which illustrates the operating steps of a system using the present invention in a system coordinated with a bowed roll spreader 20 as shown in FIGS. 1 and 2. These steps are performed by software with hardware shown in FIGS. 2, 5, 5A and 6. In one aspect of the present invention, spreader 20, located before edge spreaders EC provides an important function during the capturing mode of operation of the edge spreaders ES. During the capture mode, bowed roll spreader 20 supplies fabric F to edge spreaders ES at a controlled width, which is slightly less than the actual control width for fabric F. This slightly narrower width assures that the cord capturing mode initiated when a new fabric is first introduced into the calender line exerts a pulling force or action on the edge 50. For edge 50 to reach the desired final known location on mandrel M as detected by detector 250, the cords must actually pull outwardly by the preset narrowing amount of prior spreader 20. As indicated by block or step 300, when a new fabric F is spliced into the calender line prior sensors 40, 42 of spreader 20, as shown in FIG. 2, are set to a width 1–2 inches less than the final width W for fabric F. This is indicated by block or step 302. Thus, bowed roll spreader 20 provides an output width which is slightly less than the desired width W for a short time at the start of operation to facilitate the capture mode for edge spreader ES. This is indicated by block or step 304. This reduced output for spreader 20 is maintained for less than one minute which is sufficient time for the novel edge spreaders to capture the cords at edges 50, 52 of fabric F. Thereafter, sensors 40, 42 are reset to the normal width W. This is indicated by block or step 306. The position of mandrel support structure 100 is detected by axial transducer 140, as indicated by block or step 308. If the mandrel support structure is in the proper "home" position, the capturing mode of operation is initiated by block or step 310. If the structure is not in the proper "home" position, motor B is operated structure 100 is moved on fixed frame 110 until the proper position is obtained. This is indicated by block or step 312. The capturing mode of operation then takes place as indicated by block or step 320. When edge 50 is detected as being in the set position of detector 250, a signal is created in line 252 as indicated by block or step 322. As explained in FIG. 5A, the signal in line 252 reverses motor B and stops rotation of mandrel M by motor A. This is indicated by block or step 330. The reversal of motor B draws edge 50 outward to the desired position as detected and determined by axial transducer 140 indicated by block or step 332. When mandrel support structure 100 is moved on frame 110 so detector 250 is set to the proper position of the edge for proper width W of fabric F, detector 250 is set at the desired position or known desired location for edge 50. Detector 250 is now the edge detector for the feedback control system to control the width of fabric F by maintaining the set position of the two edges 50, 52. This is indicated by block or step 340. The same procedure acts upon both edges 50, 52. Consequently, the width of fabric F is maintained at the desired value W for introduction into calender 10. As indicated by block or step 340, detector 250 detects the position of edge 50 which position is represented by Y. If Y is greater than W, motor A is rotated in one direction to move edge 50 to the left. If Y is less than W the opposite rotation of motor M is accomplished. These operations are indicated by blocks or steps 342, 344, respectively. The width is controlled by the positions of edges 50, 52 to give the proper width W. During normal run of fabric F, sensor 250 creates a signal to control edge 50 and a similar sensor on the other edge 52 controls its lateral position. The two detectors 250 are used to control the width of the fabric. In this manner, the width of the fabric is monitored and maintained.

When it is desired to process the next fabric this is entered into the control and a signal is created as indicated by block or step 350. The parameters of operation for the fabric #2 are selected, such as "home" position, width W and cord distribution. A start sequence indicated by block or step 352 is then initiated. If this new fabric has a different cord distribution, than a new mandrel M' must be used in edge spreaders ES. An arrangement for rapidly accomplishing this objective is shown in FIGS. 5 and 6. The procedural steps shown in FIG. 11 are accomplished as software in the process controller used for operating the system and for performing the method as described.

If a different cord distribution be required for the next fabric, a rapid mandrel change mechanism is illustrated in FIGS. 5 and 6. Mandrel M' includes a pitch P' for helical groove 230'. Mandrel M' is positioned on spindle 166' carried by turret or ring 400 rotatably mounted in mandrel support structure 100 by bearing 406. Shaft 404 is rotatably mounted in bearing 406 to be indexed 180°, as illustrated in FIGS. 5 and 6. To cause this index action, a clutch 410 is actuated while motor B is rotating shaft 124. A micro switch or other proximity switch creates a signal to disconnect clutch 410 when ring 400 is rotated to the proper position where mandrel M is replaced by mandrel M'. When clutch 410 is energized, pulley 412 is driven by timing belt 414 from a pulley 416 driven by shaft 124. Thus, actuation of clutch 410 until ring 400 has been rotated 180° accomplishes a rapid exchange of mandrels for the next fabric. Thereafter, mandrel M can be removed and replaced by a mandrel needed for the next fabric to be run in line CL. Of course, ring 400 could have its own index motor and not be driven through a clutch operated by motor B.

Figure 12:
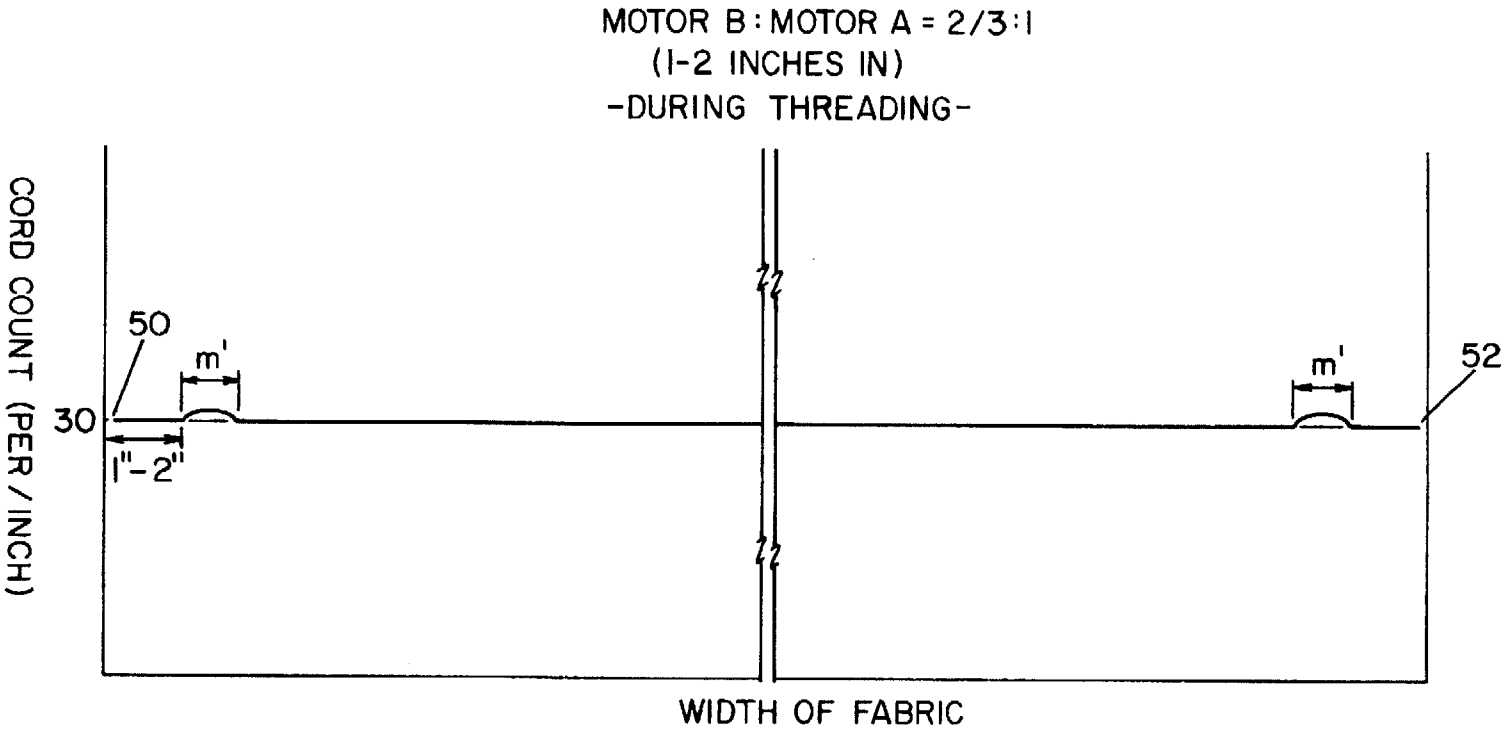
FIG. 12 is a graph similar to FIGS. 4 and 9 with the inward linear movement of the rotating mandrel during the capturing mode having a reduced rate of speed compared to the rate of the rotational speed whereby the cords are captured and pulled outwardly by the groove mandrel wherein the rotational and linear rates have a ratio of 1:⅔.
Figure 13:
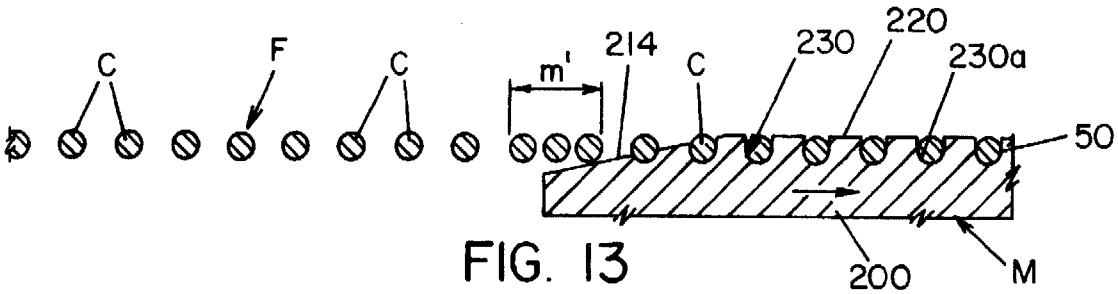
FIG. 13 is a view similar to FIG. 10 illustrating the operating characteristics of the preferred embodiment of the present invention as illustrated in the graph of FIG. 12, during the threading or capturing mode of operation; and, FIG. 14 is a graph similar to FIGS. 4, 10 and 12 showing the cord distribution across the width of the fabric during the steady state run mode of the present invention, where the invention is used for width control preparatory to the fabric entering the calender.
Figure 14:
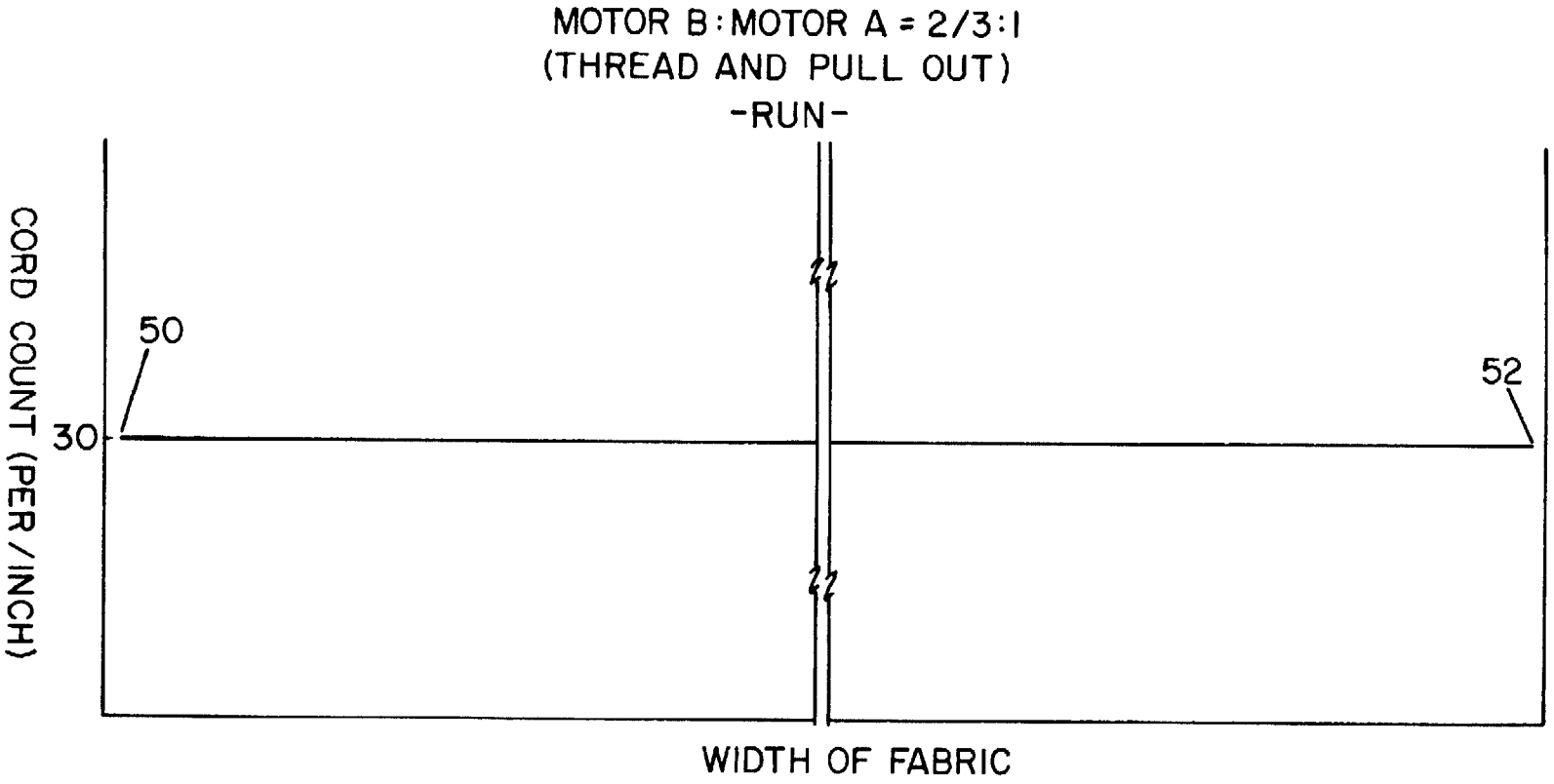

As explained with respect to FIGS. 9 and 10, inward movement of mandrel M in a coordinated 1:1 relationship with the rotational speed or rate of mandrel M tends to cause the cords to be bunched in front of the mandrel as indicated in area m. This bunching action may be alleviated when the structure 100 is moved outwardly after a signal has been created in line 252 indicating the end of the cord capturing mode of operation; however, in accordance with another aspect of the present invention and as now used, the relationship between the rate of speed of motor B and rate of speed of motor A is preferably a relationship of 1:⅔. When this ratio of the rates of speed is maintained, the rate of rotation as it is compared to the cord distribution and the rate of forward movement of the mandrel is such that the cords are pulled onto the mandrel. Thus, the rate of rotational speed of motor A is at a first rate effectively advancing the groove outwardly one pitch P in a selected time. If there are thirty cords per inch, each rotation of the mandrel moves the cords to the right 1/30 inches. Since rotational speed is in revolutions per time, this rotational movement is coordinated by time. In a like manner, the second rate of linear movement controlled by motor B advances the mandrel inwardly substantially less than one pitch P in the aforementioned "selected time". Thus, the rotation and linear motions pull the cords outwardly by the rotating groove. Indeed, in accordance with the invention, the ratio of linear speed to rotational speed factoring out the selected time is approximately 0.60–0.90. In practice, this ratio is 1:⅔. The second linear rate advances the mandrel 0.60–0.90 pitch P in the "selected time". In practice the advance is ⅔ P in the "selected time". When this ratio is accomplished, there is small bunching, in front of the mandrel, if any. As illustrated in FIGS. 12 and 13, the small area of bunching m' that does occur is removed when mandrel support structure 100 moves mandrel M to the right. This results in the run condition shown schematically in FIG. 14 wherein the fabric F has a uniform cord distribution over its total width W. During the run operation, detector 250 controls the width W by controlling the position of edges 50, 52 through a system of the type shown generally in FIG. 5A.

Having thus defined the invention, the following is claimed:

1. A spreader for spreading a fabric having upper and lower sides, transversely spaced edges and longitudinally extending tire reenforcing cords spaced laterally across said fabric between said edges preparatory to rubberizing said fabric in a calender, as said fabric moves in a given path to said calender, with said fabric having a desired transverse location for each of said edges, said spreader comprising: a cantilever mounted mandrel having an outer generally cylindrical surface concentric with a rotational axis, said cylindrical surface having a helical groove with convolutions having a pitch equal to a desired cord distribution laterally of said fabric; a mandrel support structure adjacent one edge of said fabric and having means for rotatably mounting said mandrel in a position transverse of said fabric with said cylindrical surface aligned with said fabric path to be generally tangential to a side of said fabric as said fabric moves in said given path; a first motor on said support structure for rotating said mandrel about said axis at a given rotational speed; a second motor for moving said support structure in a direction parallel to said rotational axis of said mandrel and at a given linear speed as said first motor is rotating said mandrel until a number of cords of said fabric at said one edge of said fabric are captured in said helical groove and spaced by the pitch of convolutions of said groove at said desired cord distribution; means for stopping said mandrel when said one edge is at a detected transverse location with respect to said mandrel support structure; and, feedback means for thereafter maintaining said one edge at said known desired transverse location of said one edge.

2. A spreader as defined in claim 1 wherein said feedback means includes means for creating an error signal indicative of the location of said one edge as it relates to said known desired transverse location and rotating said mandrel to move said edge to said known desired location.

3. A spreader as defined in claim 1 wherein said feedback means includes means for creating an error signal indicative of the location of said one edge as it relates to said known desired transverse location and moving said mandrel to move said edge to said known desired location.

4. A spreader as defined in claim 1 wherein said rotational speed of said first motor is at a first rotational rate effectively advancing said groove outwardly one pitch in a selected time while said linear speed of said first motor is at a second linear rate advancing said mandrel inwardly substantially less than one pitch in said selected time whereby said rotation and linear motions pull said cords outwardly by said rotating groove.

5. A spreader as defined in claim 4 wherein said second rate is in the general range of 0.6–0.9 pitch.

6. A spreader as defined in claim 1 including means for releasably connecting said mandrel to said support frame.

7. A spreader as defined in claim 1 wherein said cords have a given diameter and said helical groove has a depth generally the same as said given diameter.

8. A spreader as defined in claim 7 wherein said rotational speed of said first motor is at a first rotational rate effectively advancing said groove outwardly one pitch in a selected time while said linear speed of said first motor is at a second linear rate advancing said mandrel inwardly substantially less than one pitch in said selected time whereby said rotation and linear motions pull said cords outwardly by said rotating groove.

9. A spreader as defined in claim 8 wherein said second rate is in the general range of 0.6–0.9 pitch.

10. A spreader as defined in claim 1 including a sensor means mounted on said mandrel support structure and adjacent said mandrel for creating a signal when said one edge of said fabric is at said detected location and means for moving said mandrel support structure to place said sensor at said desired transverse location.

11. A spreader as defined in claim 10 including means for braking said first motor and reversing said second motor upon creation of said signal.

12. A spreader as defined in claim 10 wherein said rotational speed of said first motor is at a first rotational rate effectively advancing said groove outwardly one pitch in a selected time while said linear speed of said first motor is at a second linear rate advancing said mandrel inwardly substantially less than one pitch in said selected time whereby said rotation and linear motions pull said cords outwardly by said rotating groove.

13. A spreader as defined in claim 12 wherein said second rate is in the general range of 0.6–0.9 pitch.

14. A spreader as defined in claim 1 including means for introducing said fabric to said spreader with said edge in the range of ¼–1.0 inches inbound of said known desired transverse location until about the time said feedback means starts maintaining said edge at said known transverse location.

15. A spreader as defined in claim 14 wherein said rotational speed of said first motor is at a first rotational rate effectively advancing said groove outwardly one pitch in a selected time while said linear speed of said first motor is at a second linear rate advancing said mandrel inwardly substantially less than one pitch in said selected time whereby said rotation and linear motions pull said cords outwardly by said rotating groove.

16. A spreader as defined in claim 15 wherein said second rate is in the general range of 0.6–0.9 pitch.

17. A spreader as defined in claim 1 including a sensor means mounted on said mandrel support structure for creating a signal when said one edge is at said detected location and wherein said feedback means includes an error amplifier comparing a signal from said sensor means with a signal representing said known desired transverse location.

18. A spreader as defined in claim 17 wherein said rotational speed of said first motor is at a first rotational rate effectively advancing said groove outwardly one pitch in a selected time while said linear speed of said first motor is at a second linear rate advancing said mandrel inwardly substantially less than one pitch in said selected time whereby said rotation and linear motions pull said cords outwardly by said rotating groove.

19. A spreader as defined in claim 18 wherein said second rate is in the general range of 0.6–0.9 pitch.

20. A spreader as defined in claim 1 wherein said support frame includes a turret rotatable about an axis generally parallel with said axis of said mandrel and having a first connector means for connecting said first mentioned mandrel to said turret, second connector means for connecting a separate identical second mandrel to said turret and selectively operated means for rotating said mandrel between a first position with said first mentioned mandrel in the operative position tangential to said fabric and a second position with said second mandrel in said operative position.

21. A spreader as defined in claim 20 wherein said first mentioned mandrel has a helical groove with convolutions having a first pitch and second mandrel has a helical groove with convolutions having a second pitch different from said first pitch.

22. An elongated rotatable mandrel for spreading a fabric having upper and lower sides, transversely space edges and longitudinally extending tire reenforcing cords spaced laterally across said fabric between said edges preparatory to rubberizing said fabric in a calender as said fabric moves in a given path to said calender with said fabric having a desired transverse location for each of said edges, said mandrel comprising an outer generally cylindrical surface concentric with a rotational axis, said cylindrical surface having a helical groove with convolutions having a pitch generally equal to a desired cord distribution laterally of said fabric and means for connecting said mandrel to a support structure adjacent one edge of said fabric.

23. A method of spreading a fabric having upper and lower sides, transversely spaced edges and longitudinally extending tire reenforcing cords spaced laterally across said fabric between said edges preparatory to rubberizing said fabric in a calender as said fabric moves in a given path to said calender with said fabric having a desired transverse location for each of said edges, said method comprising the steps of:

(a) providing a cantilever mounted mandrel with an outer generally cylindrical surface concentric with a rotational axis, said cylindrical surface having a helical groove with convolutions having a pitch equal to a desired cord distribution laterally of said fabric;

(b) providing a support structure adjacent one edge of said fabric;

(c) rotatably mounting said mandrel with said cylindrical surface aligned with said fabric path to be generally tangential to a side of said fabric as said fabric moves in said given path;

(d) providing a first motor on said support structure for rotating said mandrel about said axis at a given rotational speed;

(e) providing a second motor for moving said support structure in a direction parallel to said rotational axis of said mandrel and at a given linear speed as said first motor is rotating said mandrel whereby a number of cords of said fabric at said one edge of said fabric are captured in said helical groove and spaced by the pitch of convolutions of said groove at said desired cord distribution until said one edge is detected by a sensor fixed with respect to said mandrel;

(f) moving said mandrel laterally until said sensor is at said known desired transverse location; and, (g) maintaining said one edge at said known desired transverse location of said one edge.

24. A method as defined in claim 23 wherein said maintaining step includes the step of rotating said mandrel to move said captured cords laterally.

25. A method as defined in claim 23 wherein said maintaining step includes the step of moving said mandrel linearly to move said captured cords laterally.

26. A method as defined in claim 23 wherein said rotational speed of said first motor is at a first rotational rate effectively advancing said groove outwardly one pitch in a selected time while said linear speed of said first motor is at a second linear rate advancing said mandrel inwardly substantially less than one pitch in said selected time whereby said rotation and linear motions pull said cords outwardly by said rotating groove.

27. A method as defined in claim 26 wherein said second rate is in the general range of 0.6–0.9 pitch.

28. A system for spreading a fabric having upper and lower sides, transversely spaced first and second edges and longitudinally extending tire reenforcing cords spaced laterally across said fabric between said edges preparatory to rubberizing said fabric in a calender, as said fabric moves in a given path to said calender, with said fabric having a desired transverse location for each of said edges, said system comprising: a first spreader for spreading said fabric to a position with said edges slightly inboard of said desired transverse location; a pair of second edge spreaders between said first spreader and said calender and adjacent said calender; said edge spreader includes a spreader unit operative with one of said edges, said spreader units each including a cantilever mounted mandrel having an outer generally cylindrical surface concentric with a rotational axis, said cylindrical surface including a helical groove with convolutions having a pitch equal to a desired cord distribution laterally of said fabric, a mandrel support structure adjacent one of said edges of said fabric and means for rotatably mounting said mandrel in a position transverse of said fabric with said cylindrical surface aligned with said fabric path to be tangential to the lower side of said fabric as said fabric moves in said given path, a first motor for rotating said mandrel to pull cords onto said mandrel in said groove and a second motor for moving said mandrel inwardly under said fabric; means for stopping rotation of said first motor when said edge has been spread by said cords engaging said groove of said rotating mandrel until said edge is at a detected location with respect to said mandrel support structure; and, feedback means for thereafter spreading said fabric to maintain the edges of said fabric at said known desired location at the calender.

29. A system as defined in claim 28 wherein said feedback means includes means for creating an error signal indicative of the location of said one edge as it relates to said known desired transverse location and rotating said mandrel to move said edge to said known desired location.

30. A system as defined in claim 28 wherein said feedback means includes means for creating an error signal indicative of the location of said one edge as it relates to said known desired transverse location and moving said mandrel to move said edge to said known desired location.

31. A system as defined in claim 28 including time delay means for causing said first spreader to spread said fabric to a position with said edges at said desired transverse locations after a predetermined time.

32. A system as defined in claim 31 wherein the rotational speed of each of said first motors of said spreader units is a first rotational rate effectively advancing said groove outwardly one pitch in a selected time while said linear speed of each of said second motors of said spreader units is a second linear rate advancing said mandrel inwardly substantially less than one pitch in said selected time whereby said rotation and linear movement pull said cords outwardly by said rotating groove.

33. A system as defined in claim 32 wherein said second rate is in the general range of 0.60–0.90 pitch.

34. A system as defined in claim 28 wherein the rotational speed of each of said first motors of said spreader units is a first rotational rate effectively advancing said groove outwardly one pitch in a selected time while said linear speed of each of said second motors of said spreader units is a second linear rate advancing said mandrel inwardly substantially less than one pitch in said selected time whereby said rotation and linear movement pull said cords outwardly by said rotating groove.

35. A system as defined in claim 34 wherein said second rate is in the general range of 0.60–0.90 pitch.

36. A system for spreading a fabric having longitudinally extending tire reenforcing cords spaced laterally across said fabric preparatory to rubberizing said fabric in a calender, said system comprises a pair of edge spreaders mounted before said calender, each of said edge spreaders including a cantilever mandrel having an outer cylindrical surface concentric with a rotational axis and generally tangential to said fabric, said cylindrical surface including a helical groove with convolutions having a pitch equal to a desired cord distribution laterally of said fabric and means for rotating said mandrel to pull cords onto said mandrel by said groove and means for moving said mandrel inwardly under said fabric and means for stopping said rotation of said mandrel when said edge has been spread by said cords engaging said groove of said rotating mandrel.

37. A system as defined in claim 36 including a feedback control means for maintaining the edges of said fabric at a desired location.

38. A system as defined in claim 37 wherein the rotational speed of each of said first motors of said spreader units is a first rotational rate effectively advancing said groove outwardly one pitch in a selected time while said linear speed of each of said second motors of said spreader units is a second linear rate advancing said mandrel inwardly substantially less than one pitch in said selected time whereby said rotation and linear movement pull said cords outwardly by said rotating groove.

39. A system as defined in claim 38 wherein said second rate is in the general range of 0.60–0.90 pitch.

40. A system as defined in claim 36 wherein the rotational speed of each of said first motors of said spreader units is a first rotational rate effectively advancing said groove outwardly one pitch in a selected time while said linear speed of each of said second motors of said spreader units is a second linear rate advancing said mandrel inwardly substantially less than one pitch in said selected time whereby said rotation and linear movement pull said cords outwardly by said rotating groove.

41. A system as defined in claim 40 wherein said second rate is in the general range of 0.60–0.90 pitch.

42. A system as defined in claim 36 wherein each edge spreader has means for stopping inward movement of said mandrel when said mandrel has moved forward to a selected position.

43. A system as defined in claim 42 wherein said means for stopping inward movement includes a sensor means for detecting the linear position of said mandrel and means for creating a stopping signal when said sensor means detects a given lateral position of said mandrel.

44. A system as defined in claim 36 wherein said stopping means is a sensor fixed laterally with respect to said mandrel having a given detect position and means for stopping said mandrel when said edge is pulled to said detect position.

45. A system as defined in claim 44 including means for rotating said mandrel to maintain said edge at said detect position.

* * * * *